US009709370B1

(12) United States Patent
Keller

(10) Patent No.: US 9,709,370 B1
(45) Date of Patent: Jul. 18, 2017

(54) TRANSPORTING AND DISPOSING OF RECALLED AIRBAG INFLATORS

(71) Applicant: John D. Keller, Knoxville, TN (US)

(72) Inventor: John D. Keller, Knoxville, TN (US)

(73) Assignee: Captive Technologies, LLC, Knoxville, TN (US)

( * ) Notice: Subject to any disclaimer, the term of this patent is extended or adjusted under 35 U.S.C. 154(b) by 0 days.

(21) Appl. No.: 15/360,910

(22) Filed: Nov. 23, 2016

Related U.S. Application Data

(60) Provisional application No. 62/336,558, filed on May 13, 2016, provisional application No. 62/401,142, filed on Sep. 28, 2016.

(51) Int. Cl.

| | |
|---|---|
| ***F42B 33/06*** | (2006.01) |
| ***B65D 43/02*** | (2006.01) |
| ***B65D 43/16*** | (2006.01) |
| ***B65D 88/12*** | (2006.01) |
| ***B65D 90/00*** | (2006.01) |
| ***B65D 90/32*** | (2006.01) |
| ***B65D 90/34*** | (2006.01) |
| ***B65B 25/00*** | (2006.01) |
| ***B65D 43/22*** | (2006.01) |
| ***B65D 47/32*** | (2006.01) |
| ***B65B 63/08*** | (2006.01) |
| ***B65D 6/08*** | (2006.01) |
| ***B65D 25/14*** | (2006.01) |
| *B60R 21/26* | (2011.01) |

(52) U.S. Cl.
CPC ..... *F42B 33/06* (2013.01); *B65B 25/00* (2013.01); *B65B 63/08* (2013.01); *B65D 7/16* (2013.01); *B65D 25/14* (2013.01); *B65D 43/0225* (2013.01); *B65D 43/16* (2013.01); *B65D 43/22* (2013.01); *B65D 47/32* (2013.01); *B65D 88/12* (2013.01); *B65D 90/0033* (2013.01); *B65D 90/325* (2013.01); *B65D 90/34* (2013.01); *B60R 21/26* (2013.01)

(58) Field of Classification Search
CPC ..... F42B 33/06; B65B 25/00; B65B 63/08; B65D 7/16; B65D 25/14; B65D 43/0225; B65D 43/16; B65D 43/22; B65D 47/32; B65D 88/12; B65D 90/325; B65D 90/34; B60R 21/26
USPC ..... 86/50; 110/237, 346
See application file for complete search history.

(56) References Cited

U.S. PATENT DOCUMENTS 3,109,369 A * 11/1963 Plumley ..... B63G 7/02 86/1.1
3,662,882 A * 5/1972 Obermayer ..... G01G 9/005 209/563
3,820,435 A * 6/1974 Rogers et al. ..... G01N 25/50 73/35.17

(Continued)

*Primary Examiner* — John D Cooper
(74) *Attorney, Agent, or Firm* — Clayton, McKay & Bailey, PC

(57) ABSTRACT

Embodiments described herein include systems and methods for safely transporting and disposing of airbag inflators. For example, a container is provided that can hold multiple airbag inflators and withstand inflator explosion resulting in failure of the metal inflator housing. The container can contain the inflator and any shrapnel associated with the explosion while also venting gases expelled as a result of the explosion. Various container designs are provided, along with methods for using these containers.

19 Claims, 9 Drawing Sheets

(56) References Cited

U.S. PATENT DOCUMENTS 3,820,479 A * 6/1974 Fylling ..... F42D 5/04 109/1 R
4,924,785 A * 5/1990 Schultz ..... C10B 7/14 110/229
5,274,356 A * 12/1993 Taricco ..... B64F 1/368 340/515
5,613,453 A * 3/1997 Donovan ..... F42B 33/06 110/237
5,668,342 A * 9/1997 Discher ..... F42B 33/06 102/293
5,741,465 A * 4/1998 Gregg ..... B09B 3/00 110/237
5,791,266 A * 8/1998 Fleming ..... F23G 7/003 110/205
5,884,569 A * 3/1999 Donovan ..... F23G 7/003 110/237
6,173,662 B1 * 1/2001 Donovan ..... F42B 33/06 110/193
6,354,181 B1 * 3/2002 Donovan ..... F42D 5/045 110/237
7,343,843 B2 * 3/2008 Sharpe ..... B65D 90/325 86/50
7,700,047 B2 * 4/2010 Quimby ..... F42B 33/067 110/235
2005/0237178 A1 * 10/2005 Stomski ..... E04H 9/06 340/521
2005/0242093 A1 * 11/2005 Sharpe ..... B65D 90/325 220/62.11
2006/0278069 A1 * 12/2006 Ryan ..... F41H 13/0043 86/50
2007/0131684 A1 * 6/2007 Cirillo ..... F42B 39/14 220/88.1
2009/0260509 A1 * 10/2009 Asahina ..... F42D 5/045 86/50
2010/0192757 A1 * 8/2010 Martin ..... F42B 33/067 86/50
2012/0312147 A1 * 12/2012 Abbe ..... F42D 5/045 86/50
2014/0008358 A1 * 1/2014 Fingerhut ..... B65D 85/00 220/1.5
2016/0372225 A1 * 12/2016 Lefkowitz ..... G21F 5/005

* cited by examiner

TRANSPORTING AND DISPOSING OF RECALLED AIRBAG INFLATORS

CROSS REFERENCE TO RELATED APPLICATIONS

This nonprovisional patent application claims priority to U.S. provisional patent application No. 62/336,558 ("Process and Apparatus for Transportation and Disposal of Recalled Airbag Inflators"), filed May 13, 2016, and further claims priority to U.S. provisional application No. 62/401,142, filed Sep. 28, 2016, both of which are incorporated by reference in their entireties.

FIELD OF THE EMBODIMENTS

The embodiments described herein related to transporting and disposing of recalled airbag inflators, including airbag inflators using ammonium nitrate propellant.

BACKGROUND

Airbags for passenger vehicles commonly use an "inflator" to inflate the airbag in case of an emergency. A typical inflator includes an ignitor and a propellant that inflates an airbag in the event of a vehicle crash. One of the world's largest airbag suppliers—Takata®—has produced a large number of defective airbag inflators. As of November 2016, over 100 million Takata® inflators have been recalled worldwide. The scale of this recall has introduced safety, logistical, and environmental challenges involved with transporting and disposing of explosive and unstable airbag inflators.

The defective inflators use ammonium nitrate ("AN") propellant. While designed to deploy upon receiving an electrical current at the inflator's initiator pins, the defective inflators can also deploy with exposure to an external heat source such as fire. According to news sources, the current, unregulated process of transporting recalled Takata® airbags has already caused at least 16 deaths. As a result, a comprehensive protocol for ensuring safe transport and disposal of recalled inflators is needed.

To gain approval for shipping on U.S. roads, all production automotive airbag inflators and energetic assemblies, such as seat belt pre-tensioners, are subjected to a Department of Transportation ("DOT") "bonfire" test. Europe's DOT equivalent, BAM, requires a similar "gas burner" test. Both the DOT and BAM tests involve exposing airbag inflators to an open-flame heat source sufficient to cause auto ignition of the inflator's main generant bed. To pass the test and be approved for shipping, an inflator must function without fragmenting due to the external heat source. Bonfire testing is the most rigorous structural test of an AN-based inflator design because ammonium nitrate propellant can melt before it burns, resulting in conditions inside the inflator that amplify challenges of ensuring the design does not fail structurally during the open flame deployment scenario.

The U.S. government, and other governments around the world, will likely classify AN-based airbag inflators as explosives or change the existing classification for recalled inflators. That new classification (or reclassification) would prevent traditional shipping methods from being used to transport these inflators. AN-based airbag inflators that are known to fragment due to over pressurization of the inflator's pressure vessel housing during normal deployment conditions at ambient outside temperature are generally expected to fail at a higher rate (or are more likely to fail) when exposed to an external heat source such as DOT Bonfire testing. An inflator sample population that exhibits any structural failures when deployed at ambient temperature is likely to exhibit a significantly higher rate of structural failure when an external heat source causes the inflator to deploy. This is because operating pressure of the inflator's internal combustion chamber tends to increase with temperature, while the steel pressure vessel strength decreases with temperature. This problem can become significantly worse if propellant melts.

Common auto-ignition materials ignite at temperatures above 130° C., which is significantly higher than any upper temperature limit the inflator design was intended to operate at during normal deployment conditions. Hence, an inflator suspected of structural failure when functioning at ambient temperature has an increasing likelihood of structural failure as temperature increases. Defective AN-based Takata® inflators can fragment even at ambient outside temperatures. Thus, they are expected to fragment more frequently if exposed to an external fire such as the DOT Bonfire test. These defective inflators are therefore not fit to be shipped using traditional methods used for non-defective inflators.

Currently, these recalled inflators are being shipped in steel drums with lids secured with tape, or in cardboard boxes, depending on the relevant state laws. These state laws have proven ineffective, as illustrated by a fatal explosion of a truck transporting recalled Takata® inflators in August 2016, in Texas. In some cases, specially designed thick-walled metal containers are being used to transport recalled inflators. However, these containers are expensive to build and are not suitable for mass production on the scale required for the current recalls. Lack of a common protocol at the national and global levels for the handling, packaging, storage, and shipment of inflators containing unstable ammonium-nitrate-based propellant may result in further human injury as well as economic and environmental damage.

As a result, a need exists for a nationally implementable, low-cost method for transporting recalled inflators. Safety concerns can be addressed with a process of modifying common containers or entire vehicles to achieve a structure and method suitable for the safe, bulk transport of recalled inflators using materials that are common across the continent, nation, or state. A method of construction and validation of the proposed shipping container designs is described for both large and small scales below.

SUMMARY

Embodiments described herein include systems and methods for safely transporting and disposing of recalled ammonium-nitrate-based airbag inflators. In one example, a method is provided for handling airbag inflators. The method can include, for example, placing live airbag inflator in a vented container. The vented container can be shaped to hold multiple live airbag inflators. The container can also withstand a detonation of an airbag inflator by retaining the detonated airbag inflator and shrapnel associated therewith and allowing gas associated with the detonation to exit the container. The words "detonate," "explode," and "deploy" are used interchangeably herein, and can refer to any condition where the metal housing fragments or fails, and/or propellant exits the body of the inflator, either intentionally or unintentionally. The propellant, along with any other chemicals or substances within the housing of an airbag inflate, can be collectively referred to as "energetics" or "energetic material."

The method can further include positioning the container in or on a transport vehicle. For example, the method can include using a forklift to lift the container from a first location and place the container in the bed of a truck. In some examples, the container can be placed in a construction-grade vehicle such as a dump truck. This portion of the method can also apply to vehicles other than road-going vehicles, such as ships or planes. In one example, the method includes placing the container in an intermodal shipping container which is then place on a truck or ship.

The method can also include measuring a first weight of the container including the live airbag inflator. The method can further include applying heat to the container sufficient to deploy the live airbag inflator. In some examples, this includes heating the container such that the inflators reach a core temperature of at least 130 degrees Celsius. In some examples, the container is heated such that the inflators reach a core temperatures of at least 180 degrees Celsius. This can include, for example, heating the container via convection, conduction, or radiation. In order to ensure complete disposal of an inflator, the inflator must reach auto-ignition temperature. The main generate bed of an inflator will typically automatically ignite at temperatures between 130 and 185 degrees Celsius. Therefore, in some examples, the inflators are heated to a temperature of about 200 degrees Celsius to ensure ignition.

A second weight of the container can be measured after applying the heat. Based on initial information such as the weight of the container and the number of inflators in the container, the difference between the weights can inform whether the inflators deploy, and if so, how many deployed. Based on the difference being above a threshold value, the deployed inflator(s) can be removed from the container.

In one example, a temperature sensor can be used to measure the temperature of an inflator in the container. In another example, the container is placed inside a disposal container prior to heating the container. The disposal container can be heated in addition to heating the container.

The container can take a variety of different forms. In one example, the container includes multiple lattices coupled to one another to form an enclosure. The enclosure can be shaped to contain multiple airbag inflators. At least one of the lattices can be coupled to another lattice via a rotatable coupling that allows a user to open and close the container. Each lattice can be strong enough to withstand deployment of one or more airbag inflators without substantial deformation of the lattice. Substantial deformation can include, for example, deformation sufficient to compromise the structural integrity of the lattice or otherwise allow any solid portion of the airbag inflators to exit the enclosure upon deployment. The lattices can be made from metal strands having sufficient thickness to provide the desired strength. For example, each strand can have a thickness of between about 0.04 inches and 1 inch.

Continuing the example, the container can include a mesh layer positioned on an inner surface of at least one of the lattices. In some examples, the mesh layer can be positioned on inner surfaces of all the lattices making up the enclosure. The term "surface" is used broadly, as the lattices can be constructed from metal strands and therefore not have a continuous inner or outer surface. However, the inner and outer sides of the plane formed by the lattice can be considered surfaces for the purposes of this disclosure.

The mesh layer can include apertures or perforations sized to allow passage of gas while preventing passage of shrapnel from a deployed airbag inflator. For example, the apertures can be sized to prevent a sphere having a diameter of at least 0.9 inches from passing through the mesh layer. The container can also include an environmental barrier layer positioned on an outer surface of at least one of the lattices. The environmental barrier layer can include a material, such as plastic or a high-temperature, fire-retardant silicone foam, that prevents moisture from passing through that lattice. In some examples, the environmental barrier can be attached in such a way that it rips or detaches from the container to allow sufficient venting in the event of an inflator deploying.

In another example, a container can include a cylindrical sidewall and a solid cap coupled to a first end of the cylindrical sidewall. For example, the container can include a metal barrel with one end welded closed. The container can also include a vented cap removably coupled to a second end of the cylindrical sidewall. The vented cap can be shaped to allow passage of gas through the vented cap while preventing passage of shrapnel from a deployed airbag inflator. For example, the vented cap can include apertures sized to allow passage of gas but not shrapnel.

Continuing the example, the container can include a baffle positioned to redirect shrapnel from a deployed inflator away from the vented cap. The baffle can include, for example, one or more metal plates positioned near the vented cap. The baffle can be coupled to the cylindrical sidewall or to the vented cap. An environmental barrier can be coupled to the vented cap to prevent moisture from penetrating the container.

In yet another example, a container can include multiple solid metal sidewalls coupled to one another. In that example, at least one side of the container can include a lattice or grate that allows passage of gas but retains the inflators and any shrapnel associated with a deployed inflator. At least one of the solid metal sidewalls can be rotatably coupled to another sidewall such that a user can open and close the container.

A detailed description of these examples, and other examples, is provided below. Both the foregoing general description and the following detailed description are exemplary and explanatory only and are not intended to restrict the scope of the invention as claimed.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Reference will now be made in detail to the present exemplary embodiments, including examples illustrated in the accompanying drawings. Wherever possible, the same reference numbers will be used throughout the drawings to refer to the same or like parts.

This disclosure describes a variety of containers that can be used to safely transport or dispose of airbag inflators. While these containers, and the methods of using them, can be applied to any type of airbag inflators, they are also intended to safely handle recalled airbag inflators produced by Takata®. Due to manufacturing defects, these recalled inflators have an increased likelihood of exploding when subjected to heat. References to "inflators" or "airbag inflators" herein are also assumed to encompass the recalled defective inflators from Takata®.

The containers described herein can be used for transporting inflators, disposing of inflators, or both. During the transportation stage, a container should provide safety from explosions while also aiding a user in filling the container, locking the container, and loading or unloading the container on or off a vehicle. Of course, the container must also be able to withstand forces generated from structural failure of inflator housings inside the container while venting gases appropriately.

At the disposal stage, a container can be used to intentionally deploy inflators by applying heat, such as fire, to the container. In the disposal process, the container might experience high temperatures and/or come in direct contact with an open flame. The container should be able to withstand these temperatures while still retaining all shrapnel related to inflator deployment and venting gases appropriately. Ideally, the container should be reusable. In some examples, the container can be used both for transportation and disposal, improving efficiency of the overall recall process.

Containers can come in a wide range of sizes. On the small end of the spectrum, a container can be sized to hold a single inflator. On the other hand, a container can be sized to occupy the bed of a dump truck or a large, intermodal shipping container. In some examples, a container can be sized between these two extremes, such that the containers can be easily moved while also holding a moderate number of inflators. For example, a container can be sized to accommodate a forklift, allowing a forklift operator to handle the containers without getting closer than necessary.

Figure 1:
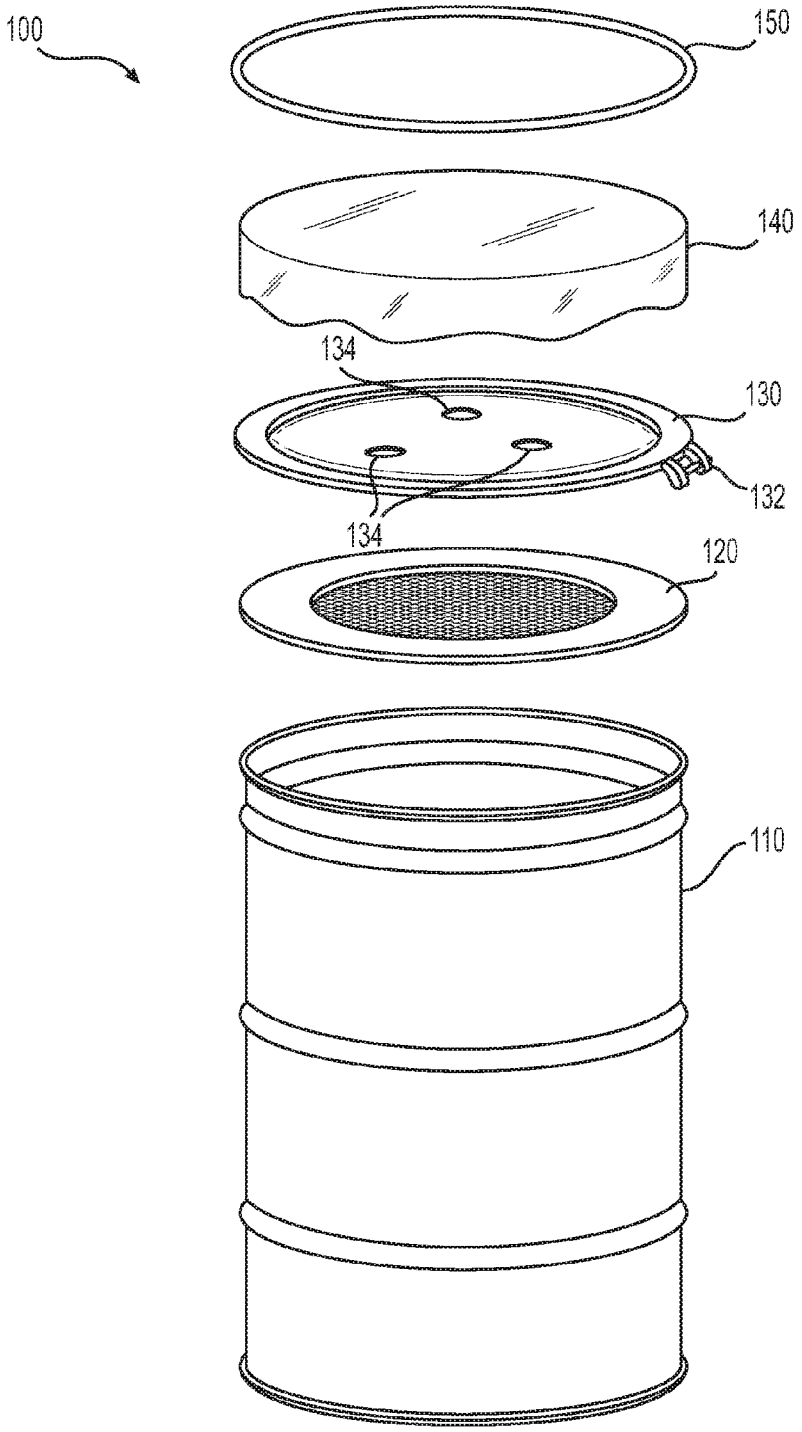
FIG. 1 is an illustration of an example container for safely transporting and/or disposing of airbag inflators.

Due to the extent of the Takata® recall, many containers may need to be constructed. To keep costs low, these containers can be constructed from readily available materials. For example, FIG. 1 shows a container 100 that is based on a commonly available steel drum. That drum, denoted cylinder 110 in FIG. 1, can include a cylindrical sidewall as well as a solid cap coupled to the bottom end of the cylinder 110. As shown in the drawing, the cylindrical sidewall need not be a perfectly shaped cylinder. Instead, it can include structural ridges, a lip at the top and bottom, and other variations. Although cylinders provide more strength per volume, other shapes can be used as well, such as a rectangle. The cylinder 110 can be made from a heavy gauge steel, such as 16-Ga or thicker.

The container 100 of FIG. 1 also includes a shrapnel barrier 120. The shrapnel barrier 120 can be constructed such that shrapnel from a deployed inflator cannot pass through the barrier, while gases emitted from the deployed inflator can pass through. For example, the shrapnel barrier 120 can include a mesh, screen, grate, fencing, or lattice sized to accomplish these goals. In another example, the shrapnel barrier 120 can be a solid plate with apertures that accomplish the same goals. In either case, the shrapnel barrier 120 can include openings—such as an aperture or a space between four strands of a mesh—that are one square in or smaller. In some examples, shrapnel barrier 120 includes openings that are 0.5 square inches or smaller. In other examples, shrapnel barrier 120 includes openings that are 0.25 square inches or smaller.

Shrapnel barrier 120 can be made from a resilient material, such as steel, to ensure that deployed inflators and the resulting shrapnel does not damage the shrapnel barrier 120 and form larger openings that can allow shrapnel to pass through. The shrapnel barrier 120 can be a removable component, as shown in FIG. 1, or can be part of the cylinder 110 or the lid 130. For example, the shrapnel barrier 120 can be welded to the top of the cylinder 110. In that case, the cylinder 110 can include a door on the side for loading and unloading the container.

FIG. 1 also shows a lid 130 that can be removably or rotatably coupled to the cylinder 110 and/or shrapnel barrier 120. For example, the lid 130 can be secured to the cylinder 110 via a hinge joint 132 and a latching mechanism. The hinge joint 132 can be coupled to the cylinder 110, such as by welding, to ensure that the lid 130 stays attached to the cylinder 110. The latching mechanism can include a component attached to the cylinder 110 and an associated component attached to the lid 130. These two components can interact to form a latching mechanism. Alternatively, those components can be integrally formed into the cylinder 110 and lid 130, respectively.

The lid 130 can include openings 134 to allow gases to vent from the cylinder 110. For example, the lid 130 can be made from one or more solid pieces of steel with multiple apertures formed in the lid 130. In one example, the lid 130 includes apertures formed by drilling. In another example, the lid 130 includes apertures punched through the lid 130. In yet another example, the lid 130 includes a mesh portion that allows gas to vent. The mesh portion can include, for example, a section of a chain-link fence.

When used with a shrapnel barrier 120, the openings 134 in the lid 130 can be larger than the openings in the shrapnel barrier 120. For example, the openings 134 in the lid 130 can be between about 0.5 to about 8 square inches. The total surface area of the openings 134 in the lid 130 should be sufficient to allow gas to flow through at a rate that prevents unwanted pressure build-up in the container 100. In some examples, the total surface area of the openings 134 in the lid 130 is equal to, or greater than, the total surface area of the openings 134 in the shrapnel barrier 120.

The container 110 can also include an environmental barrier 140. The environmental barrier 140 can be made from a moisture-impermeable material, such as a plastic sheet. The environmental barrier 140 can be sized to cover the lid 130 and/or shrapnel barrier 120, preventing moisture from entering the openings in the lid 130 and/or shrapnel barrier 120. The environmental barrier 140 can be secured to the container 100 using, for example, a band 150 as shown in FIG. 1. The band 150 can be sized such that it stretches to fit around the cylinder 110, with the environmental barrier 140 under the band 150. The tension in the band 150 can keep the environmental barrier 140 in place. Other mechanisms can hold the environmental barrier 140 in place, such as attaching the barrier 140 to a hook attached to the cylinder 110.

The environmental barrier 140 can be designed and attached such that it prevents moisture from entering the container 100 when attached, but also allows gas to vent from the container 100 in the event of a deployment. In one example, the band 150 maintains tension sufficient to hold the environmental barrier 140 in place under normal circumstances, but allows the environmental barrier 140 to release when subjected to a high-pressure event such as an airbag inflator deployment. For example, when an airbag deflator explodes, the resulting pressure can force at least a portion of the environmental barrier 140 to release from under the band 150, allowing the gas to escape. In another example, the pressure due to a deployment can cause the environmental barrier 140 to rip. This can provide a visual cue to determine whether any inflators in a container 100 have deployed.

Figure 2:
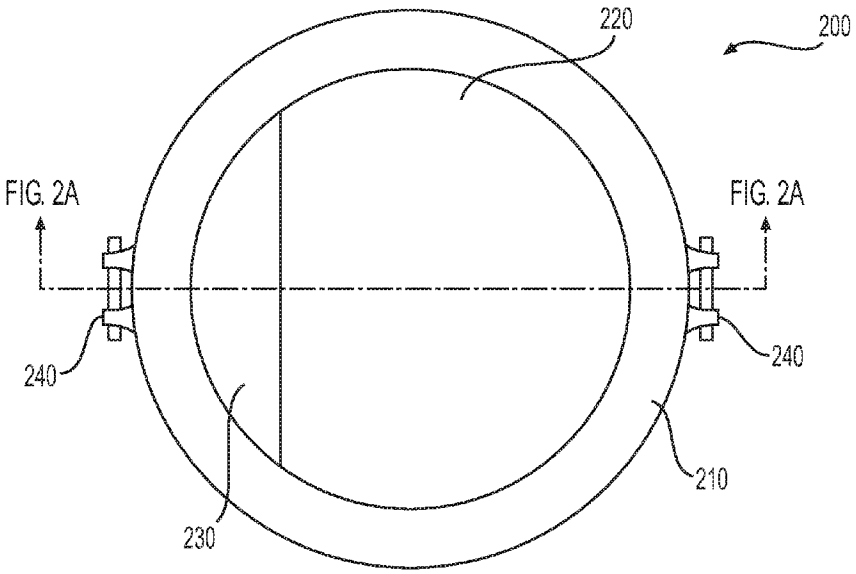
FIG. 2 is an illustration of an example container lid that includes a baffle built into the lid.

FIG. 2 provides an illustration of an example lid 200 that includes a baffle built into the lid 200. The lid 200 of FIG. 2 can be used with the container 100 of FIG. 1, or any other cylindrical-shaped container. The lid 200 can be secured to a container using the mounts 240. In one example, the mounts 240 can include removable pins that can interface with both the container and the lid 200. In another example, one mount 240 is a hinge mount coupled to both the container and the lid 200, allowing the lid 200 to rotate about the hinge for opening and closing the container. In that example, the other mount 240 can include a locking mechanism.

Figure 2A:
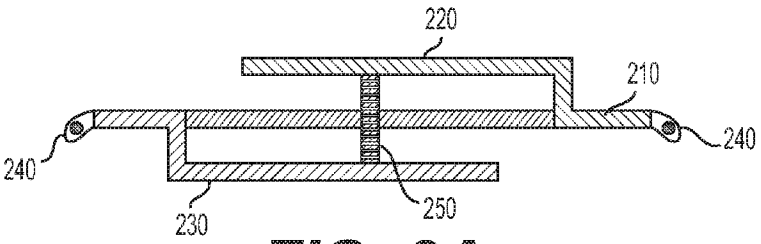
FIG. 2A is a cross-sectional view of the example container lid of FIG. 2.

The lid 200 can also include an upper baffle plate 220 and a lower baffle plate 230. The baffle plates 220, 230 can be oriented such that shrapnel from a deployment within the container is unlikely to escape. As shown in FIG. 2A, the lower baffle plate 230 can be oriented such that it is perpendicular to a longitudinal axis of the container (not shown). Shrapnel traveling in a direction parallel to the longitudinal axis of the container would likely contact the lower baffle plate 230 and be redirected back down. Some shrapnel traveling parallel to the longitudinal axis can miss the lower baffle plate 230 and instead contact the upper baffle plate 220. However, the upper baffle plate 220 is also oriented perpendicular to the longitudinal axis, which would therefore redirect shrapnel back down into the container.

If shrapnel enters the space between the upper and lower baffle plates 220, 230 traveling in a trajectory that is not parallel with the longitudinal axis of the container, a grate 250 oriented between the baffle plates 220, 230 can block the shrapnel from passing through the lid 200. The grate 250 can be any type of material that blocks shrapnel but allows gas to pass through. For example, the grate 250 can be a wire mesh, a metal plate with openings in it, parallel slats, chain-link fencing, or any other suitable material. The openings in the grate 250 can be less one square inch in one example. In another example, the openings in the grate 250 can be greater than one square inch, but less than half an inch wide at any point.

Figure 3:
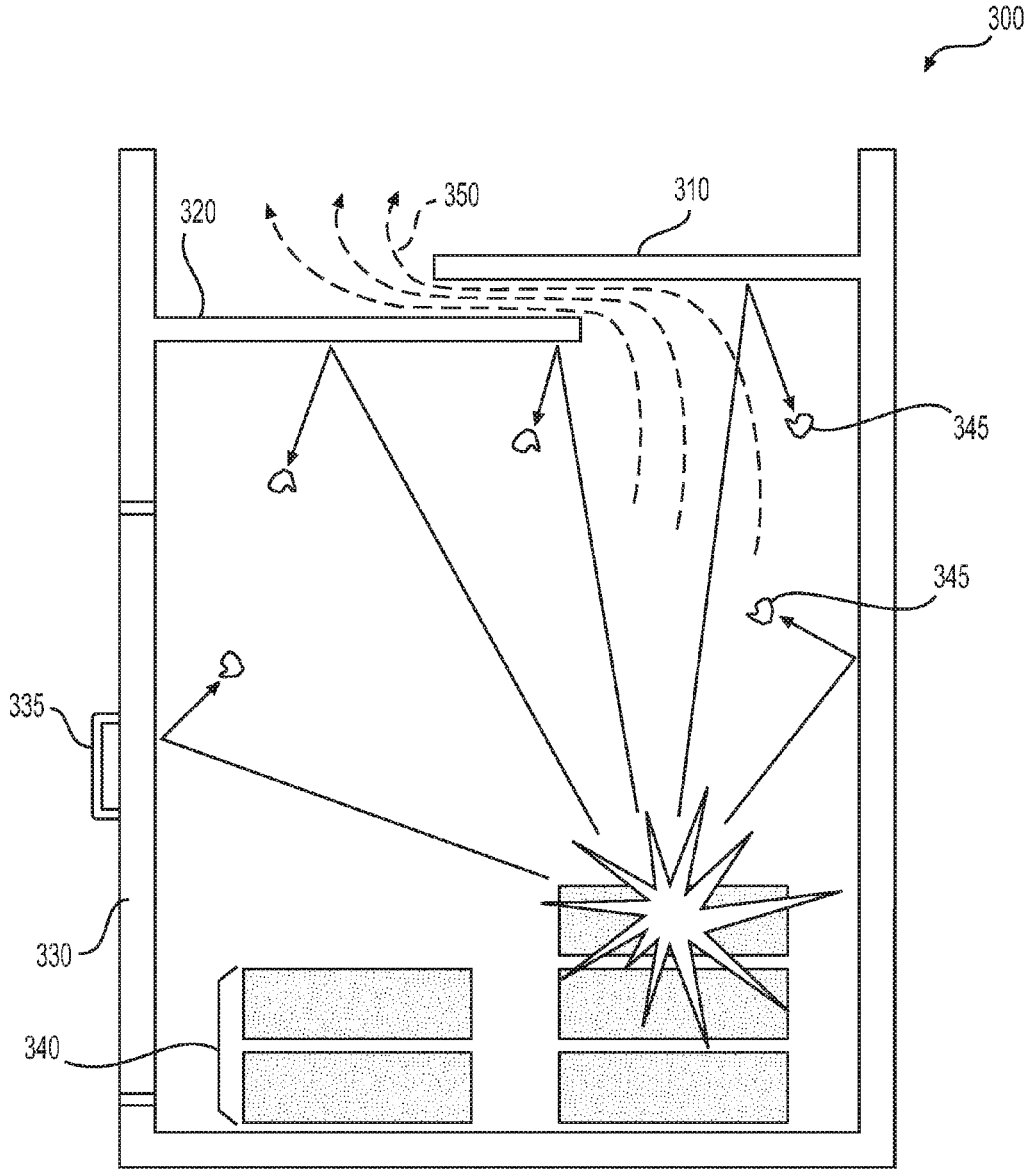
FIG. 3 is a diagram of an example container including a baffle and showing example travel paths of shrapnel and gas from a deployed inflator.

FIG. 3 provides a diagram of a container 300 experiencing an airbag-inflator deployment. The container 300 can be a cylinder, rectangle, or any other shape. In this example, the container 300 includes an upper baffle 310 and a lower baffle 320 built into the container 300 itself. Because the baffles 310, 320 are integrated with the container 300, the container 300 includes a door 330 that provides access to the interior of the container 300. To load or unload the container, a user can open the door 330 via the handle 335 and access the interior of the container 300.

In the example of FIG. 3, the container 300 includes five inflators 340. A container 300 can be sized to hold more than five inflators 340, however, and this quantity is merely chosen as one example. In practice, a particular container design can be tested to establish a "containable load" for the container. For example, the container can be subjected to the "DOT Bonfire" test (also known as the "UN6(c) Bonfire Test") with a single inflator, then two inflators, and so on, until the container is unable to perform suitably. After establishing the maximum inflator load that a container can handle, a safety factor can be applied to establish a containable load. For example, 80% of the maximum can be used to establish a containable load. In that example, a container design that can contain up to 20 inflators in a DOT Bonfire test would have a containable load of 16 inflators.

In the example of FIG. 3, one of the five inflators 340 has deployed. The deployment has ejected several pieces of shrapnel 345 from the inflator 340. In practice, the size, number, and makeup of the shrapnel 345 can vary greatly from one deployment to the next. In some cases, the inflator 340 itself may propel itself in various directions as the propellant escapes the body of the inflator 340. As shown in FIG. 3, the shrapnel 345 impacts the sidewalls of the container 300 as well as the upper and lower baffles 310, 320 of the container 300. In each case, the shrapnel is redirected from the wall or baffle back into the container 300.

Meanwhile, gases 350 expelled from the deployed inflator 340 can travel between the upper and lower baffles 310, 320 of the container and escape into the atmosphere. The distance between the upper and lower baffles 310, 320 can be optimized to provide the smallest opening without unduly restricting the flow of gas 350. This size can depend on the containable load for the container 300, as a larger containable load will require a larger exit port for gases 350. In practice, the baffles 310, 320 can be oriented such that they allow sufficient venting for a deployed containable load while maintaining the smallest opening possible. Additionally, the lengths of the baffles 310, 320 can be optimized to reduce the chance of shrapnel 345 exiting the container 300 while still allowing gas 350 flow. For example, the overlapping portions of the upper and lower baffles 310, 320 can be increased or decreased relative to the overlap shown in FIG. 3.

Figure 4:
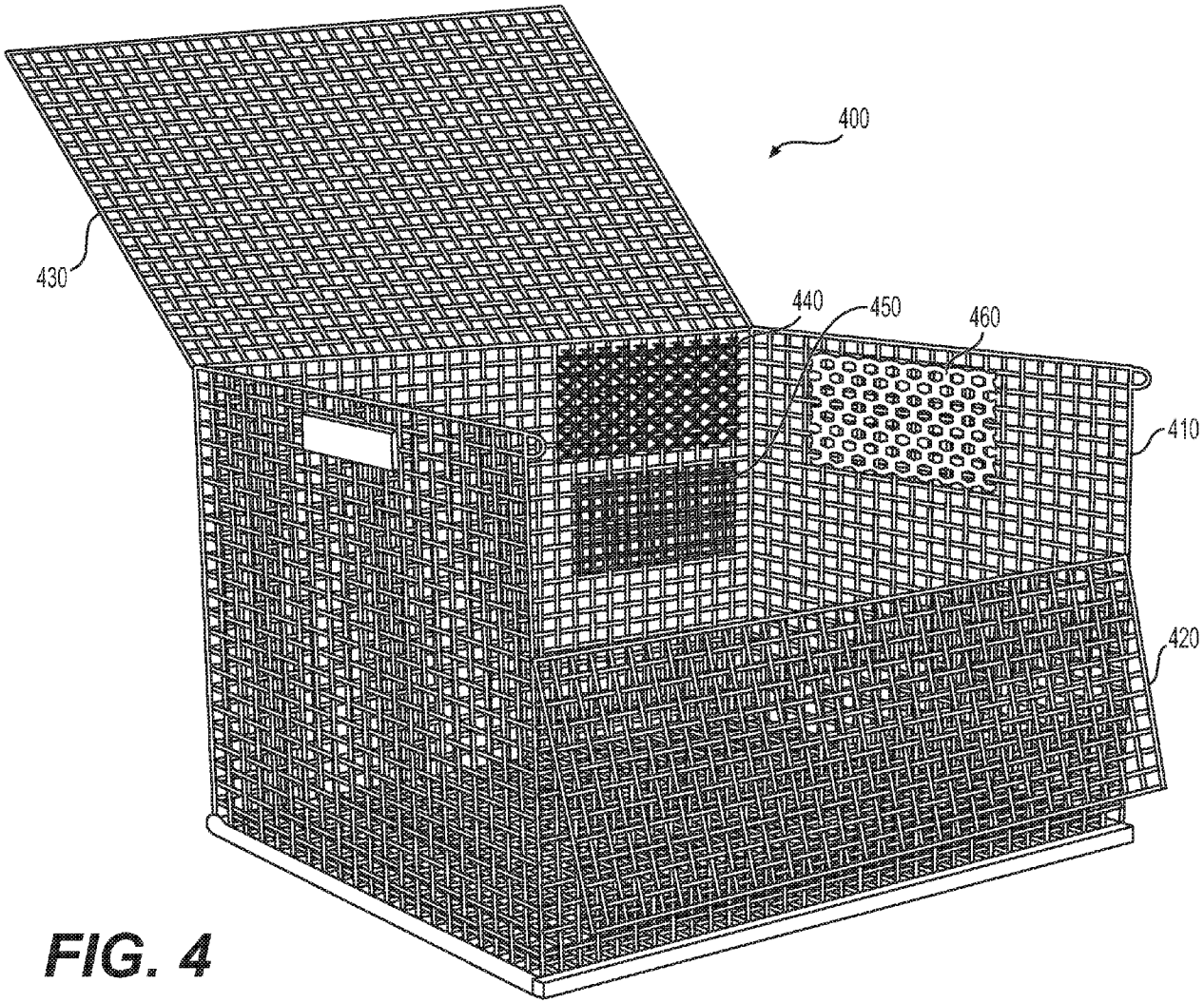
FIG. 4 is an illustration of an example container including an outer structural lattice and example inner mesh layers.

FIG. 4 provides an illustration of an example container 400. The container 400 of FIG. 4 includes a lattice structure forming a rectangular box. For example, the container 400 includes multiple sidewall lattices 410, a rotatable top lattice 430, and a rotatable front lattice 420. While this example depicts both the top and front lattices 430, 420 as rotatable, the container 400 can also have only one of those lattices rotatable while the other is fixed. However, having both lattices 430, 420 rotatable provides a larger opening for loading and unloading the container 400. The top and front lattices 430, 420 can include a locking mechanism that locks the lattice structure 410, 420, 430 together.

The lattices can be constructed from wire mesh, such as a metal wire or fencing. The thickness of the wire can be between about 0.09 inches and 0.6 inches, in one example. The openings in the lattice structure can be sized such that a sphere having a diameter greater than 0.5 inches would not fit through the openings. Other sizes can be used as well. If the lattice structure has openings that are small enough, then an inner mesh layer is not necessary.

Figure 4B:
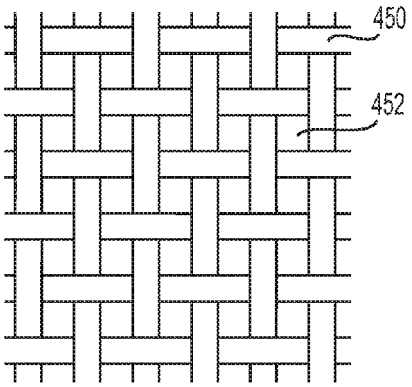
FIG. 4B is an expanded view of an example inner mesh layer of FIG. 4.
Figure 4C:
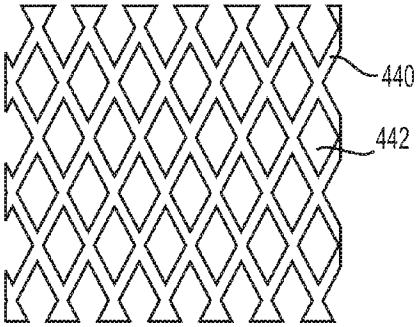
FIG. 4C is an expanded view of an example inner mesh layer of FIG. 4.
Figure 4A:
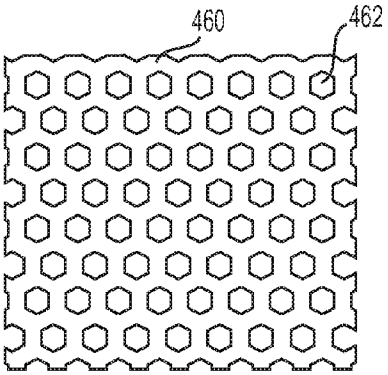
FIG. 4A is an expanded view of an example inner mesh layer of FIG. 4.

In the example of FIG. 4, however, various inner mesh layers 440, 450, and 460 are shown. Mesh layer 440 is shown in greater detail in FIG. 4C, mesh layer 450 is shown in greater detail in FIG. 4B, and mesh layer 460 is shown in greater detail in FIG. 4C. Although they take different shapes, each mesh layer 440, 450, 460 includes openings 442, 452, and 462, respectively, that are sized to prevent shrapnel from passing through the mesh layer while allowing gases to vent through. These openings 442, 452, 462 can be sized such that a sphere having a diameter of 0.25 inches or greater cannot pass through the mesh layer. Larger or smaller openings 442, 452, 462 can be used. Although the mesh layers 440, 450, 460 are shown as covering only a small portion of a lattice 410, in practice a mesh layer can cover an entire lattice. In some examples, each lattice component of the container 440 includes an interior mesh layer.

In some examples, an environmental barrier can be used with the container 400 to prevent rain or other moisture from entering the container 400. For example, a plastic sheet can be secured to the top of the container to prevent fluid from dropping down into the container 400 while also allowing the sides of the container 400 to vent gases. In some examples, the environmental barrier can cover multiple sides of the container 400. The environmental barrier can be configured such that it releases from the container 400 or rips apart when deployment occurs.

Figure 5:
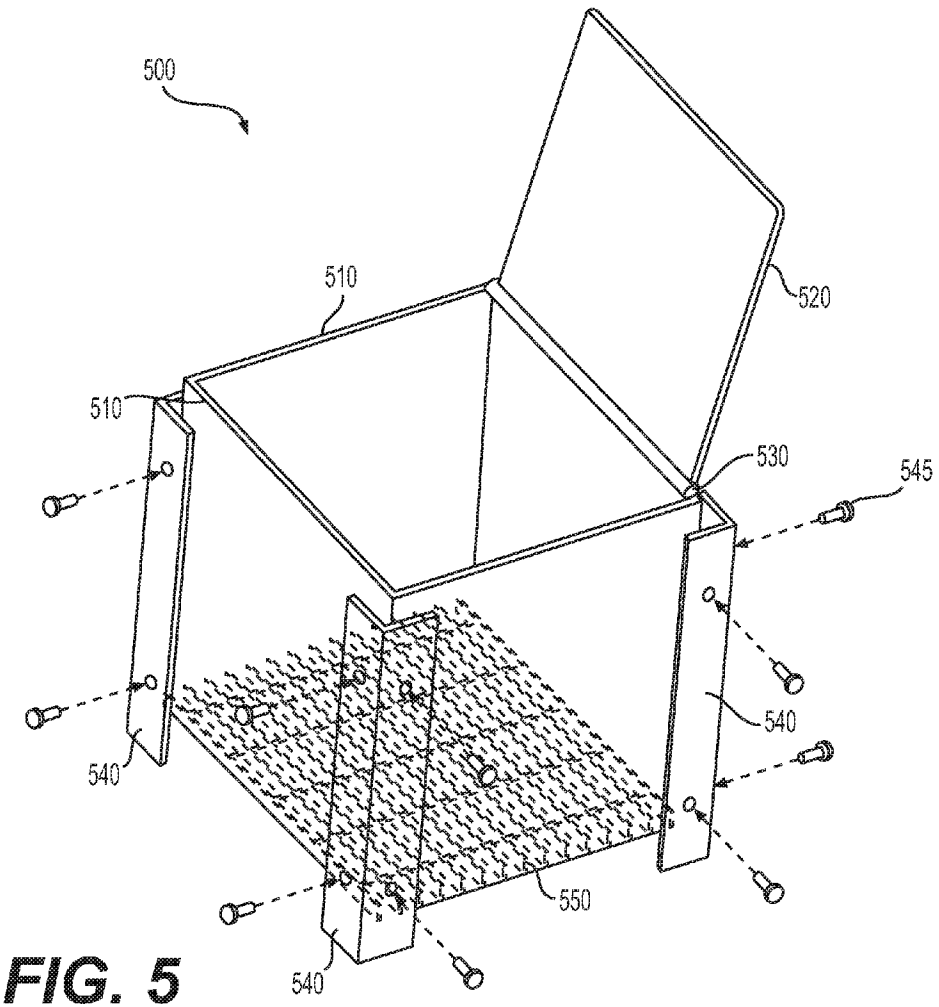
FIG. 5 is an illustration of an example container with multiple solid sides and a grate that allows gas to escape the container.

FIG. 5 is an illustration of an example container 500 constructed from readily available materials such as steel plates and a grate. In this example, the container 500 includes four sidewalls 510 joined together via 90-degree brackets 540 and fasteners 545. Although fasteners 545 are shown here, other methods, such as welding, could be used instead. The sidewalls 510 can be made from a strong, solid material such as a steel. Other materials can be used as well, with varying thickness based on the strength of the material. Regarding steel, an example type of steel plate that can be used for a sidewall 510 is 0.25-inch-thick 4130 steel. These types of steel plates can be purchased off the shelf in a 2-foot by 2-foot configuration, for example.

An example bracket 540 that can be purchased off the shelf is 90-degree-angle steel, 0.25-inch-thick, 2 feet long, and 2 inches wide and deep. The brackets 540 can be positioned such that they extend beyond the base of the sidewalls 510, as shown in FIG. 5, such that the brackets 540 are the only components of the container 500 touching supporting the container 500 when positioned on flat ground.

A top plate 520 can be used to seal the top portion of the container 500. The top plate 520 can be made from a similar steel plate as used for the sidewalls 510. The top plate 520 can be coupled to one of the sidewalls 510 via a hinge joint 530. In this example, the hinge joint 530 spans one edge of the top plate 520, although in other examples the hinge joint 530 can be smaller, such as an embodiment using two or three hinge joints 530. The top plate 520 can include a locking mechanism that locks the top plate to one of the sidewalls 510 when closed.

A grate 550 can be coupled to the sidewalls 510 via one or more brackets 540. The grate 550 can be an off-the-shelf item, such as a 2-foot by 2-foot grate with slats having a height of 1 to 1.5 inches, width of 0.25 inches, and about 1 inch between slats. These types of grates are commonly used for roads and sidewalks, for example. Other types of grates or mesh can be used as well, such as a metal-wire mesh, chain-link fencing, or other suitable types. An additional steel plate can optionally be attached to the base of the brackets 540, such that the container 500 is fixed on the optional steel plate and includes a gap between the optional steel plate and the grate 550. Fixing the container 500 to the steel plate improves safety in the event of a tip-over, due to fire, explosions, or an accident involving the transport vehicle.

When deployment occurs within the container 500 of FIG. 5, gas can escape through the grate 550 of the container 500. In some examples, the grate 550 can be sized such that no shrapnel can pass through the grate 550. In other examples, the grate 550 can be sized to allow small shrapnel pieces to pass through the grate 550. However, because the grate 550 is at the bottom of the container 500, the shrapnel would do minimal damage, especially when the container 500 is placed on the ground or on top of a solid surface, or when the steel plate is fixed to the legs of the container below the grate.

In some examples, wheels can be affixed to the container 500 to allow the container 500 to be more easily moved from one location to another. For example, commonly available caster wheels can be mounted to the container 500. In one example, metal fasteners are used to fasten the caster wheels to the container 500. Similar wheels can be attached to any of the containers disclosed herein.

Although FIG. 5 shows a container with solid sides, a solid top, and a grate on the bottom, other configuration are also possible. For example, the grate can be placed on any side of the container, or on the top of the container. In some examples, only one grate is used and the remaining surfaces are solid. In other examples, multiple grates are used and the remaining surfaces are solid. In yet other examples, all of the surfaces are solid and no grates are used. Any combination can be used based on the intended use of the container.

Figure 6:
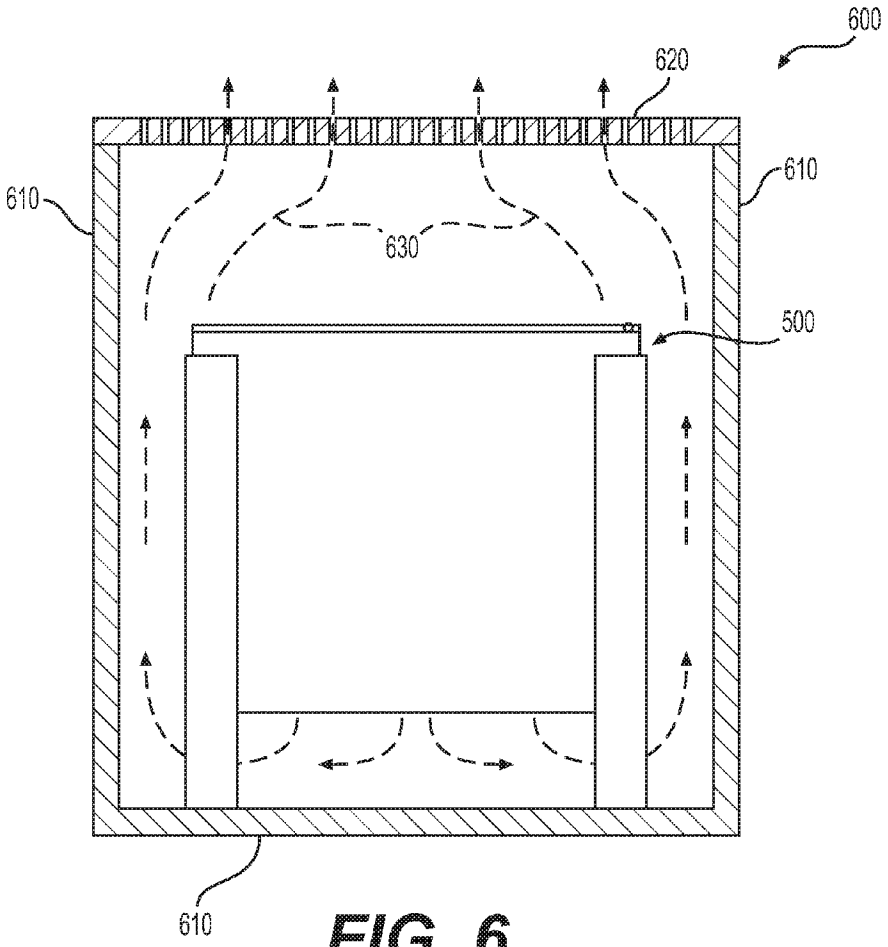
FIG. 6 is an illustration of an example container inside a disposal container, showing the path for gases to escape both containers.

FIG. 6 provides an illustration of an example embodiment of a disposal container 600 within which the container 500 from FIG. 5 is place. In some examples, the container 500 of FIG. 5 can be used directly as a disposal container, for example by applying heat to the container 500 sufficient to trigger inflator deployment within the container 500. In other examples, the container 500 can be placed within a larger disposal container 600 that can capture any shrapnel exiting the smaller container 500.

As shown in FIG. 6, for example, the disposal container 600 can include solid walls 610, including a base 610, that can capture any shrapnel ejected through the grate 550 of the container 500 inside the disposal container 600. The disposal container 600 can include a vented lid 620 that allows gases 630 from deployed inflators to exit the disposal container 600. In some examples, the disposal container 600 can work without any lid at all, especially in cases where the container 500 inside the disposal container 600 is expected to retain shrapnel.

Although FIG. 6 shows the container 500 of FIG. 5 within the disposal container 600, any type of container can be placed inside the disposal container 600. For example, the containers of FIG. 1, 3, or 4 can be placed inside the disposal container 600. In some examples, the disposal container 600 is sized to accommodate multiple transport containers. In that example, a single disposal container 600 can be used to "cook off" inflators within multiple transport containers. This can make the process more efficient depending on the facilities used to heat the disposal container 600. The transport containers may also be exposed to an open, uncontained heat such as a flame for the purpose of disposing of the inflators.

Figure 7:
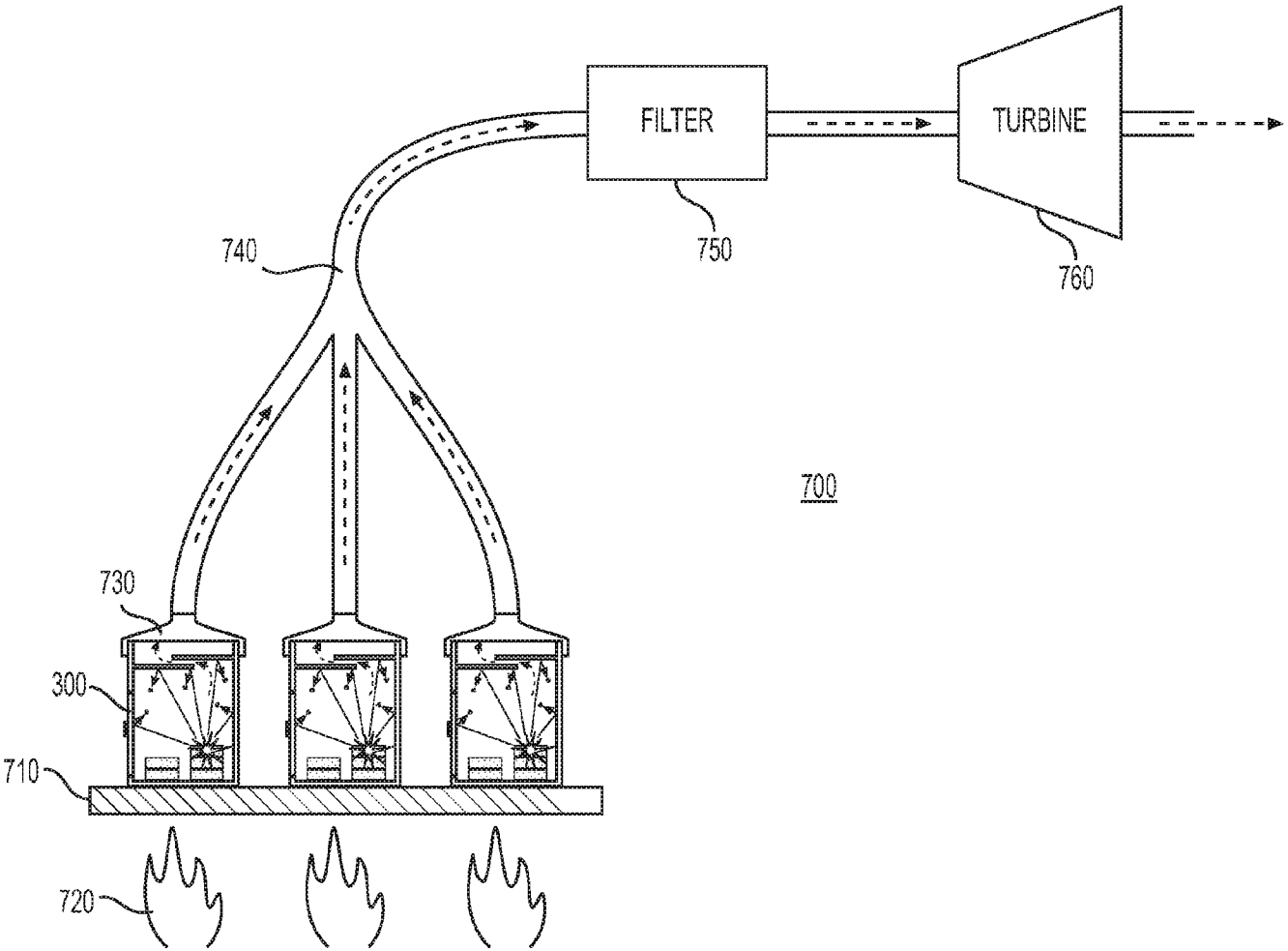
FIG. 7 is a diagram of an example system for disposing of airbag inflators and extracting power from the gases expelled from the inflators.

During the disposal process, large amounts of energy can be released from inflators by the combustion of inflator propellant. A single passenger-side airbag inflator can release 4 moles of matter, in the form of gas, at temperatures in excess of 400 degrees Celsius. FIG. 7 provides an illustration of an energy recovery system 700 that can be used to recover energy produced by inflator propellant combustion. The example of FIG. 7 shows three of the containers 300 described with respect to FIG. 3. The containers 300 are placed on a heating surface 710 that can accommodate several containers 300. Heat 720 can be applied to the heating surface 710, or applied directly to the containers 300 in some examples. In one example the heating surface 710 can be a large grate that allows flames 720 to pass through and contact the containers 300. In another example, the heating surface 710 is a solid surface that is heated via flames 720 and then transfers heat to the containers 300 via conduction. Any type of heat-transfer mechanism can be used, including conduction, convection, induction, or radiation.

As shown in FIG. 7, a hood 730 can be attached to each container 300. The hood 730 can be configured to seal around the top of the container 300, forcing any gas produced via deployment to enter the hood 730. The hood 730 can connect to piping 740 that routes the high-energy gas away from the container 300. In the example of FIG. 7, several hoods 730 connect to piping 740 that joins together and routes toward a filter 750.

The filter 750 can prepare the gas flow for entering a turbine 760. Based on the needs of the turbine 760, the filter 750 can be designed to provide an appropriate level of filtering. For example, the filter 750 can be a simple grate or mesh that prevents solid shrapnel particles from entering the turbine 760. In another example, the filter 750 can include a filter medium, such as paper or charcoal, that removes certain particulates from the gas flowing through the piping 740. The filtered gas then enters the turbine 760 and causes the turbine 760 to produce power that can be harnessed and reused. For example, the turbine 760 can be used to power a heating mechanism that produces and applies heat to the heating surface 710. Other energy-recovery mechanisms can be used in place of a turbine. For example, the expelled gases can be used to heat a boiler.

In one example, the containers are heated using excess heat created from a process unrelated to the inflators. For example, the containers can be heated using excess heat from a power generation process at a coal plant or nuclear plant. In that example, the containers can be made to interface with a heat source that provides rejected heat from the power generation process. For example, if the heat is rejected from the power generation process via air, the exhaust manifold that exhausts the heated air can be attached to a container. The container can include an a manifold that mates with the exhaust manifold to direct the heated air toward the inflators in the container. In an example where the heat is rejected from the power generation process via a liquid, the container can include a heat exchanger that can intercept the heated liquid, extract heat from the liquid, and direct the liquid back to its original path. The shape and size of the container can be modified to fit any type of heat source. Using heat waste from an industrial process can lower the costs for disposing of the recalled inflators.

Figure 8:
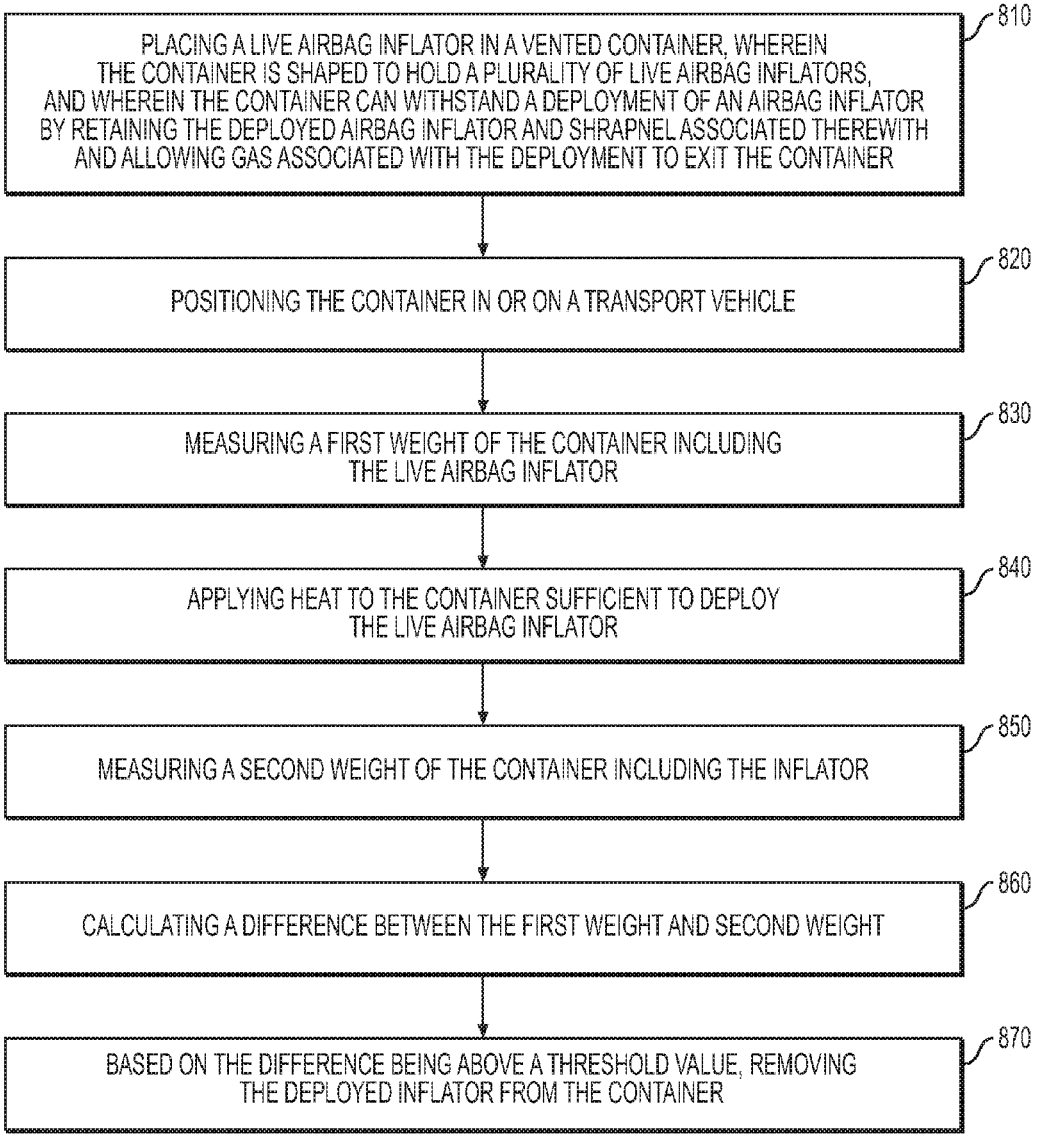
FIG. 8 is a flowchart of an example method for handling airbag inflators.

FIG. 8 is a flowchart of an example method for handling airbag inflators. Stage 810 of the method can include placing a live airbag inflator in a vented container, such as one of the containers disclosed above with respect to FIGS. 1-7. The container can be shaped to hold multiple live airbag inflators, and can withstand a deployment of an airbag inflator by retaining the deployed airbag inflator and shrapnel associated therewith while allowing gas associated with the deployment to exit the container.

Stage 820 of the method can include positioning the container in or on a transport vehicle. This can include, for example, lifting the container by hand and placing it in a truck bed. In another example, a forklift, crane, or other lifting mechanism can be used to lift the container and move it. The transport vehicle can be any type of vehicle, including a car, truck, ship, train, or airplane. In some examples, the container is already positioned on a transport vehicle before stage 810 takes place. For example, a container can be constructed using a standard inter-modal shipping container. The shipping container can include a lattice structure similar to that described with respect to FIG. 4. In that example, the shipping container can be positioned on the trailer of a truck before the airbag inflators are positioned in the container.

Stage 830 can include measuring a first weight of the container including the live airbag inflator. For example, the container can be placed on a large scale to determine a total weight. In another example, a lifting mechanism can measure the weight of the container as the container is positioned on a transport vehicle at stage 820. This stage can also include noting the total number of inflators in the container, as well as the number of driver-side inflators, passenger-side inflators, side-impact inflators, and curtain inflators.

Stage 840 includes applying heat to the container sufficient to deploy a live airbag inflator. This can include, for example, applying a flame directly to the container. In another example, heated air can be directed toward the container. In yet another example, a heating surface can conduct heat into the container. In one example, the container is heated such that the inflators reach a minimum internal temperature of 130 degrees Celsius. In another example, the container is heated such that the inflators reach a minimum temperature of 180 degrees Celsius. In yet another example, the container is heated such that the inflators reach a minimum temperature of 200 degrees Celsius.

Stage 850 can include measure a second weight of the container including the inflator. For example, at the conclusion of the heating process, the container can be placed on a scale. A single passenger-side inflator typically loses approximately 80-140 grams of mass due to a deployment. A single driver-side inflator typically loses approximately 20-50 grams of mass due to a deployment. A single side-impact inflator typically loses approximately 20-40 grams of mass due to a deployment.

Stage 860 can include calculating a difference between the first weight and the second weight. The difference between these two weights can indicate whether any inflators within the container have deployed, and if so, how many. The difference between the first and second weights can also be divided by the number of inflators in the container to determine an average weight difference per inflator.

Based on the difference between the first and second weight being above a threshold value, at stage 870, the exploded inflator can be removed from the container. The threshold value can be based on the number of inflators in the container. As an illustration, an example container can hold 10 driver-side inflators and 10 passenger-side inflators. An estimation can predict that the driver-side inflators will lose 300 grams (30 grams each) if all inflators deploy, while the passenger-side inflators will lose 1000 grams (100 grams each) if they all deploy. In that example, the difference between the first and second weight should be above a threshold that is close, or equal to, 1300 grams. If the difference is substantially less than 1300 grams in that example, then the container can undergo further heating, including being heated at a higher temperature than previously. After the additional heating, a replacement second weight can be obtained and used to calculate a weight difference from the first weight.

In one example, a large-scale shipping container can be used for transporting airbag inflators. For example, a commonly used 30-yard dumpster or dump truck bed rated for 20-ton gravel loads can be used. A smaller metal shipping container could also be nested inside a larger one to achieve sufficient container integrity, such as small dumpster housed inside a larger dumpster. The purpose of the shipping container can be to prevent inflator metal fragments from exiting the sidewall of the container and directing all energy that results from inflator deployments up toward the top of the container.

Another purpose of the shipping container can be to prevent propagation of an explosion. In some examples, recalled inflators can have characteristics that create a risk of an explosion propagating to nearby inflators. This can be specified in the new classification, or reclassification, that applies to recalled inflators. The risk of propagation can be lessened by controlling the size of the "containable load" used with each container. However, the containers can be designed to withstand propagation and prevent explosions from propagating across containers.

Continuing the large-scale shipping container example, a containment blanket can be used to prevent shrapnel from escaping the container. The containment blanket can include a net or mesh structure that prevents shrapnel from passing through the containment blanket. The blanketing structure on top of the inflator load can prevent over-pressurization of the shipping container if inflators deploy inside the container, allowing inflator combustion gases to vent while preventing metal inflator fragments of critical mass from exiting the top of the container. Examples of suitable material for the containment blanket are expanded steel mesh or grates with properly sized openings. Another example of a suitable material is a chain-link fencing material.

The large-scale shipping container can also be implemented in a similar manner with respect to rail cars or barges, such that the inflators can be shipped via rail or water.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for handling airbag inflators, comprising:

placing a live airbag inflator in a vented container, wherein the container is shaped to hold a plurality of live airbag inflators, and wherein the container can withstand a deployment of an airbag inflator by retaining the deployed airbag inflator and shrapnel associated therewith and allowing gas associated with the deployment to exit the container;

positioning the container in or on a transport vehicle;

measuring a first weight of the container including the live airbag inflator;

applying heat to the container sufficient to deploy the live airbag inflator; and measuring a second weight of the container including the inflator.

2. The method of claim 1, wherein applying heat to the container further comprises measuring the temperature of the inflator via a temperature sensor.

3. The method of claim 1, further comprising, prior to applying heat to the container, placing the container in a disposal container, wherein applying heat to the container comprises applying heat to the disposal container.

4. The method of claim 1, wherein applying heat to the container comprises subjecting the inflator to a temperature of at least 130 degrees Celsius for a duration of time.

5. The method of claim 1, further comprising calculating a difference between the first weight and second weight, and based on the difference being above a threshold value, removing the exploded inflator from the container.

6. The method of claim 5, wherein the threshold value is calculated based on the number of inflators in the container.

7. The method of claim 5, wherein the threshold value is calculated based on a number of driver-side inflators and a number of passenger-side inflators in the container.

8. The method of claim 1, wherein the container comprises a shrapnel barrier comprising a plurality of apertures sized to prevent shrapnel from passing through the barrier but allowing gas to pass through the barrier.

9. The method of claim 1, wherein applying heat to the container comprises subjecting the inflator to a temperature of at least 185 degrees Celsius for a duration of time.

10. The method of claim 1, wherein applying heat to the container comprises subjecting the inflator to a temperature of at least 200 degrees Celsius for a duration of time.

11. A method for handling airbag inflators, comprising:

placing a live airbag inflator in a vented container;

positioning the container in or on a transport vehicle;

measuring a first weight of the container including the live airbag inflator;

applying heat to the container sufficient to deploy the live airbag inflator; and measuring a second weight of the container including the inflator.

12. The method of claim 11, wherein applying heat to the container further comprises measuring the temperature of the inflator via a temperature sensor.

13. The method of claim 11, further comprising, prior to applying heat to the container, placing the container in a disposal container, wherein applying heat to the container comprises applying heat to the disposal container.

14. The method of claim 11, further comprising calculating a difference between the first weight and second weight, and based on the difference being above a threshold value, removing the exploded inflator from the container.

15. The method of claim 14, wherein the threshold value is calculated based on the number of inflators in the container.

16. The method of claim 11, wherein the container comprises a shrapnel barrier comprising a plurality of apertures sized to prevent shrapnel from passing through the barrier but allowing gas to pass through the barrier.

17. The method of claim 11, wherein applying heat to the container comprises subjecting the inflator to a temperature of at least 130 degrees Celsius for a duration of time.

18. The method of claim 11, wherein applying heat to the container comprises subjecting the inflator to a temperature of at least 185 degrees Celsius for a duration of time.

19. The method of claim 11, wherein applying heat to the container comprises subjecting the inflator to a temperature of at least 200 degrees Celsius for a duration of time.

* * * * *